US007434340B2

(12) United States Patent
Virvo

(10) Patent No.: US 7,434,340 B2
(45) Date of Patent: Oct. 14, 2008

(54) STACKABLE FOLDING DISPLAY STRUCTURE

(76) Inventor: Alexander Virvo, 33 Glen Ter., Stamford, CT (US) 06906

( * ) Notice: Subject to any disclaimer, the term of this patent is extended or adjusted under 35 U.S.C. 154(b) by 191 days.

(21) Appl. No.: 10/975,961

(22) Filed: Oct. 28, 2004

(65) Prior Publication Data

US 2005/0155259 A1 Jul. 21, 2005

Related U.S. Application Data

(60) Provisional application No. 60/515,168, filed on Oct. 28, 2003.

(51) Int. Cl.
*G09F 1/00* (2006.01)
*G09F 7/00* (2006.01)
*G09F 1/06* (2006.01)

(52) U.S. Cl. ..... 40/124.09; 40/605

(58) Field of Classification Search ..... 40/605, 40/124.19, 124.14, 124.12, 539
See application file for complete search history.

(56) References Cited

U.S. PATENT DOCUMENTS

| | | | | |
|---|---|---|---|---|
| 1,742,858 | A * | 1/1930 | Heinz | 40/124.19 |
| 2,840,293 | A * | 6/1958 | Paige | 206/736 |
| 3,601,916 | A * | 8/1971 | Epstein | 40/605 |
| 4,372,086 | A * | 2/1983 | Hanlon | 40/605 |
| 5,960,848 | A * | 10/1999 | Schirer | 40/539 |
| 6,438,877 | B1 * | 8/2002 | Ruiz | 40/539 |

* cited by examiner

*Primary Examiner*—Robert J Sandy
(74) *Attorney, Agent, or Firm*—Grimes & Bettersby, LLP; James F. McLaughlin

(57) ABSTRACT

A foldable display is provided having at least three panels hingedly connected to each other, wherein the panels include means for receiving corresponding means on other displays for interlocking and stacking the displays. In the preferred embodiment, these means comprise at least two slits provided at the top of each display and at least two slits provided at the bottom of each display, which slits cooperate to create complementary tabs on adjacent displays, which tabs interlock with each other to frictionally attach one display on top of another. A separate header unit, also including slits disposed therein, may be mounted to the top of an assembled display to further buttress the structural stability of the unit.

11 Claims, 11 Drawing Sheets

STACKABLE FOLDING DISPLAY STRUCTURE

This is a non-provisional application claiming benefit of priority of provisional application Ser. No. 60/515,168 filed on Oct. 28, 2003

BACKGROUND OF THE INVENTION

1. Field of the Invention

The present invention relates generally to foldable displays of the type typically used for presentations such as at science fairs, and more particularly, to foldable displays that are interlocking and stackable so as to create larger and more complicate structures, and even more particularly to foldable displays having at least three panels hingedly connected to each other, wherein the panels include means for receiving corresponding means on other displays for interlocking and stacking the displays.

2. Description of the Prior Art

In today's competitive world, in the area of presentation and display there is a continuing need to standout from the competition. More and more emphasis is placed on not just the content of the presentation but on the visual appeal of the presentation itself. Local, regional and national science fairs or History Day competitions are just some examples where presentations are judged not just on content but on visual appeal.

In visiting such a competition, one will see a myriad of presentations, mostly produced on flat presentation boards that have a large center panel with a right and left panel that swings open forming a display structure. The majority of presentations are produced on flat presentation boards measuring 36" tall and 48" wide in the open position. There are also several shorter and narrower displays offered in the marketplace.

Most such competitions have regulations regarding the size of the exhibits allowed. The width is usually limited to 48"; however, the height restriction is usually 110" with a depth of 30". These size limitations may vary slightly, although the allowable height is usually greater than the displays offered in the marketplace. The reasons for these restrictions are that offering larger presentation displays would be cumbersome to sell at retail, and expensive to ship, and unwieldy to carry to and from school, such as taking it in a car or bus, and finally would require a large space for storage, which space often comes at a premium.

Due to the unwieldy nature of merchandising tall temporary displays, there are very few places where one may purchase such an item. There are a few resellers on the Internet that offer tall displays. However these displays are often expensive to purchase and to ship, and as a result out of the reach of the masses.

With all of these obvious negatives and the difficulty of obtaining tall displays, at these competitions one will see many tall exhibits and presentations where the creator of the exhibit will have built a custom tall exhibit from wood, cardboard, or, with the help of tape or adhesive, or other fastening mechanism, will have stacked two or more flat presentation boards to reach a desired height.

There are a variety of existing structures that are designed to fold flat and assemble easily to achieve great heights. There are already a number of such patented constructions that achieve this in different way. Examples include Swingbox, Adbox, and a variety of pop-up display structures that use clever means to set up into a taller structure, such as with the use of rubber bands. Another widely known method of creating a taller structure is by folding it, as in an easel type display for a life sized celebrity that unfolds and is set up in a promotional or merchandising venue.

Although the other solutions exist in the marketplace, some of which are rather elegant, they are expensive to produce, often requiring sophisticated production methods and/or hand assembly as in the pop up rubber band mechanisms.

SUMMARY OF THE INVENTION

Against the foregoing background, it is a primary object of the present invention to provide a stackable folding display that allows one flat presentation board to be easily stacked on top of another by way of interlocking tabs created by slits.

It is another object of the present invention to provide a stackable folding display that uses a friction fit created by the tabs to hold the displays in position during presentation and does not require a separate adhesive or mechanism.

It is yet another object of the present invention to provide a stackable folding display that includes a header which provides a visually desirable look to a presentation, and offers substantial stability in the stacking of the flat displays.

It is but another object of the present invention to provide a stackable folding display that is ideal for purposes of making taller presentations, because it is very easy to assemble and easy and quick to disassembled for ease of portability and storage.

It is yet still another object of the present invention to provide a stackable folding display that is very easy to assemble and easy and quick to disassembled for ease of portability and storage.

It is another object of the present invention to provide a stackable folding display that ensures that the proper alignment of the displays in relation to each other each time the display is assembled or disassembled because of the exact position of the slits.

It is but another object of the present invention to provide a stackable folding display that prevents damage to the displays as may be caused by other methods of fastening.

It is yet another object of the present invention to provide a stackable folding display that allows for the creation promotional structures that achieve certain heights and are yet easy to assemble and inexpensive to ship, and if need be easy to store.

It is still another object of the present invention to provide a stackable folding display that is easy to store.

To the accomplishments of the foregoing objects and advantages, the present invention, in brief summary, comprises a foldable display having at least three panels hingedly connected to each other, wherein the panels include means for receiving corresponding means on other displays for interlocking and stacking the displays. In the preferred embodiment, these means comprise at least two slits provided at the top of each display and at least two slits provided at the bottom of each display, which slits cooperate to create complementary tabs on adjacent displays, which tabs interlock with each other to frictionally attach one display on top of another. A separate header unit, also including slits disposed therein, may be mounted to the top of an assembled display to further buttress the structural stability of the unit.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
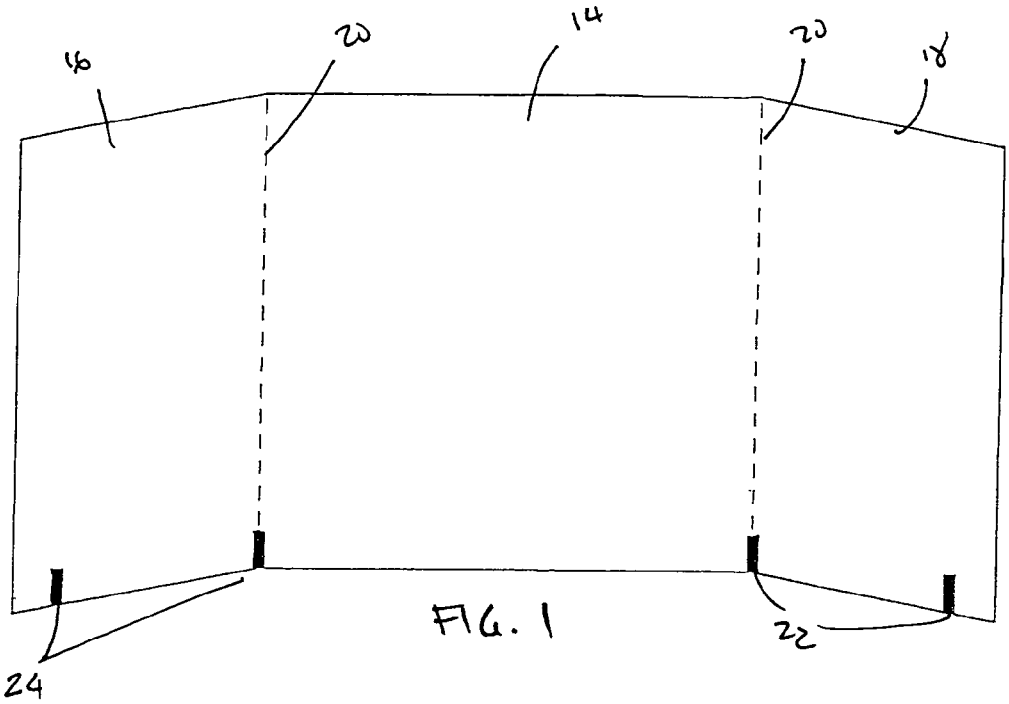
FIG. 1 is a perspective illustration of the foldable display structure of the present having slits disposed on the bottom.

Referring to the drawings and, in particular, to FIG. 1 thereof, the stackable folding display structure of the present invention is provided and is referred to generally by reference numeral 10. The display structure 10 comprises a construction made from substantially light weight material, such as corrugated paper, plastic, cardstock, paperboard and other flexible materials.

Figure 10A:
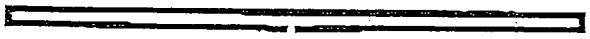
FIGS. 10A-10E are top plan views and front views of the foldable display structures of the present invention in which the left and right panels are of different sizes.
Figure 10A:
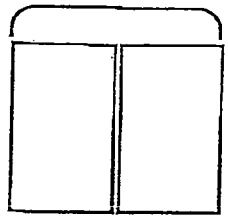
Figure 10B:
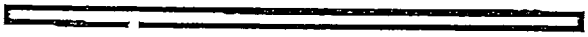
Figure 10B:
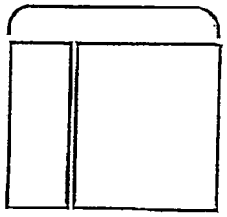
Figure 10C:
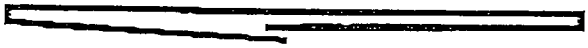
Figure 10C:
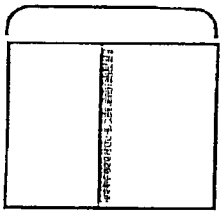
Figure 10D:
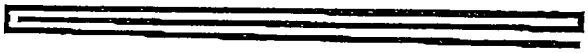
Figure 10E:
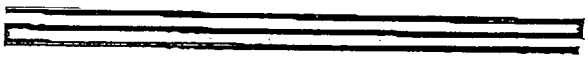
Figure 10E:
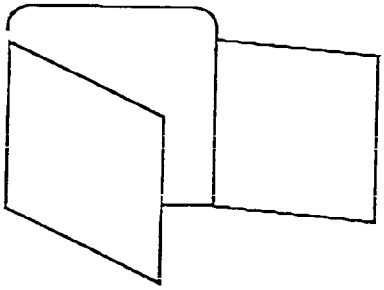
Figure 11:
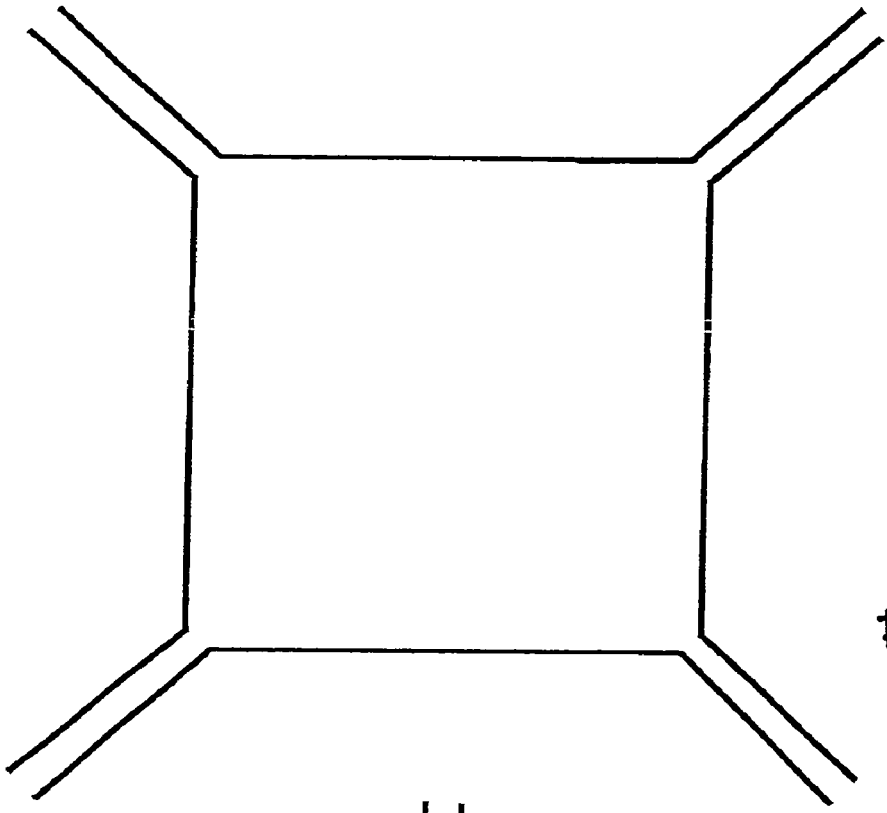
FIG. 11 is a top plan view of one arrangement for multiple foldable display structures of the present invention.
Figure 12:
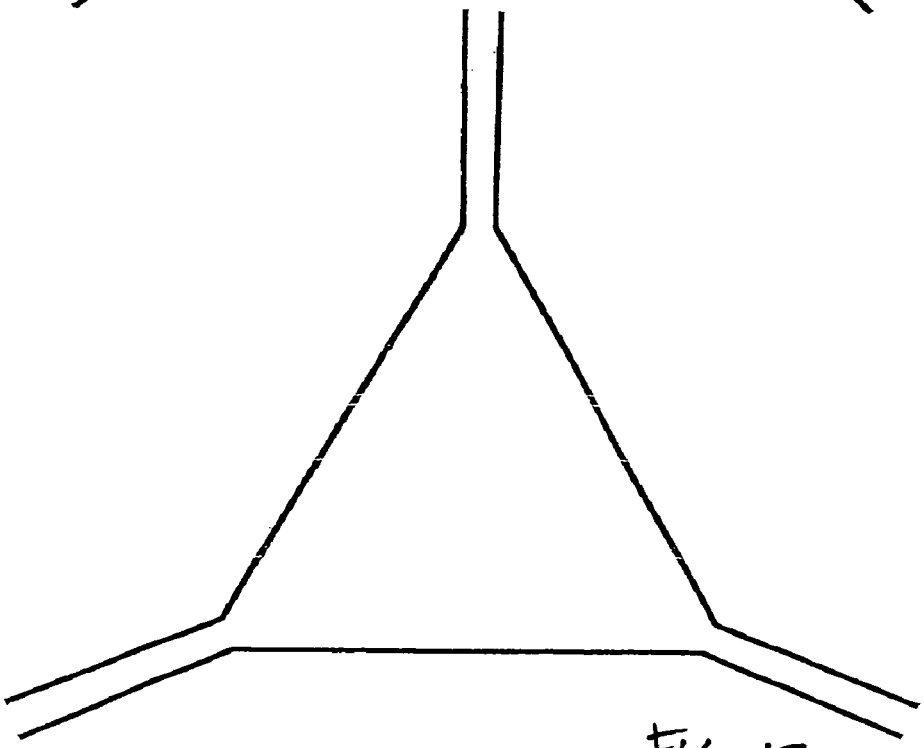
FIG. 12 is a top plan view of another arrangement for multiple foldable display structures of the present invention.

In the preferred embodiment, the display structure 10 comprises at least three panels 12 including a center panel 14, to either side of which are a left panel 16 and a right panel 18. While in the preferred embodiment, the left panel 16 and the right panel 18 are of identical size and shape, each having a width approximately half that of the center panel 14, the left panel 16 and right panel 18 may made of varying widths. Illustrated in FIGS. 10A-10E are examples of some of the various sized left and right panels 16, 18, which illustrations show the display structure 10 in the close position wherein the left and right panels 16, 18 are either folded in front of the center panel 14, behind the center panel 14 or to either side of the center panel 14. For example, FIG. 10A shows the left and right panels 16, 18 being of approximately half the width of the center panel 14, while FIGS. 10D and 10E show these panels 16, 18 to be approximately the same width as the center panel 14. In FIG. 10B one of the panels 16, 18 is wider than the other, although the combined width is approximately the same as that of the center panel 14, whereas in FIG. 10C the left and right panels 16, 18 are slightly larger than half the width of the center panel, and they overlap each other.

In the preferred embodiment, left and right panels 16, 18 and center panel 14 are formed from one single sheet of material, and are separated by flexible hinges 20 which allow the panels 16, 18 to be folded back and forth relative to the center panel 14. Such hinges 20 may be created by scoring the material of the panels 14, 16, 18 or by merely compressing the material to create the hinge 20. Alternatively, a separate hinge mechanism may be provided, although such mechanism would undoubtedly increase the cost of manufacture of the display structure 10.

Figure 2:
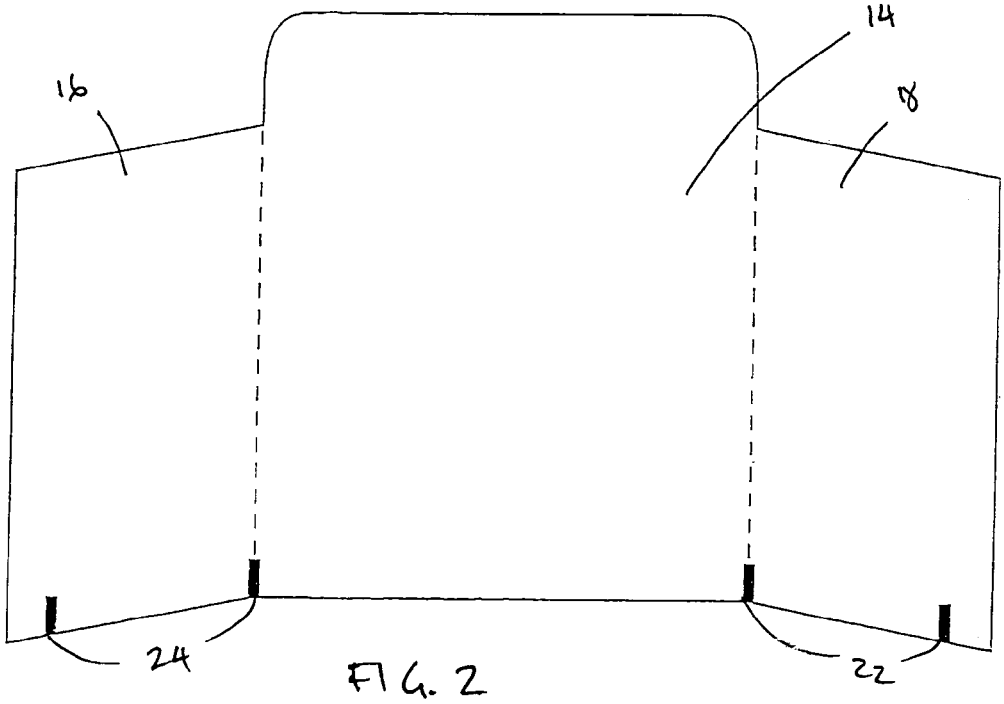
FIG. 2 is a perspective illustration of the foldable display structure of the present having slits disposed on the bottom and a header on the center panel.
Figure 3:
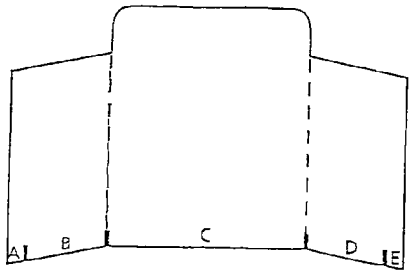
FIG. 3 is a perspective illustration of the foldable display structure of the present having slits disposed on the bottom and a header on the center panel.
Figure 4:
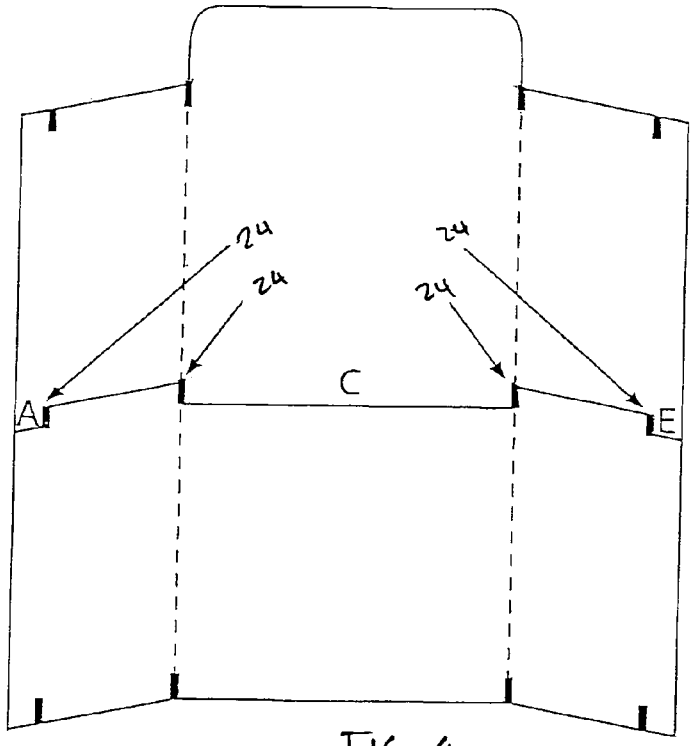
FIG. 4 is a perspective illustration of two stacked foldable display structures, each including slits on the upper and lower edges, the upper structure including a header.
Figure 6:
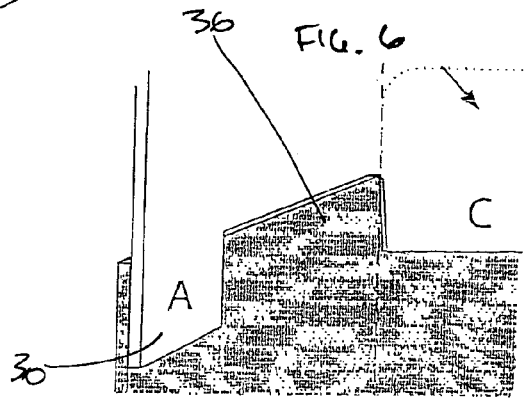
FIG. 6 is a perspective illustration of the means by which adjacent structures are attached.
Figure 7:
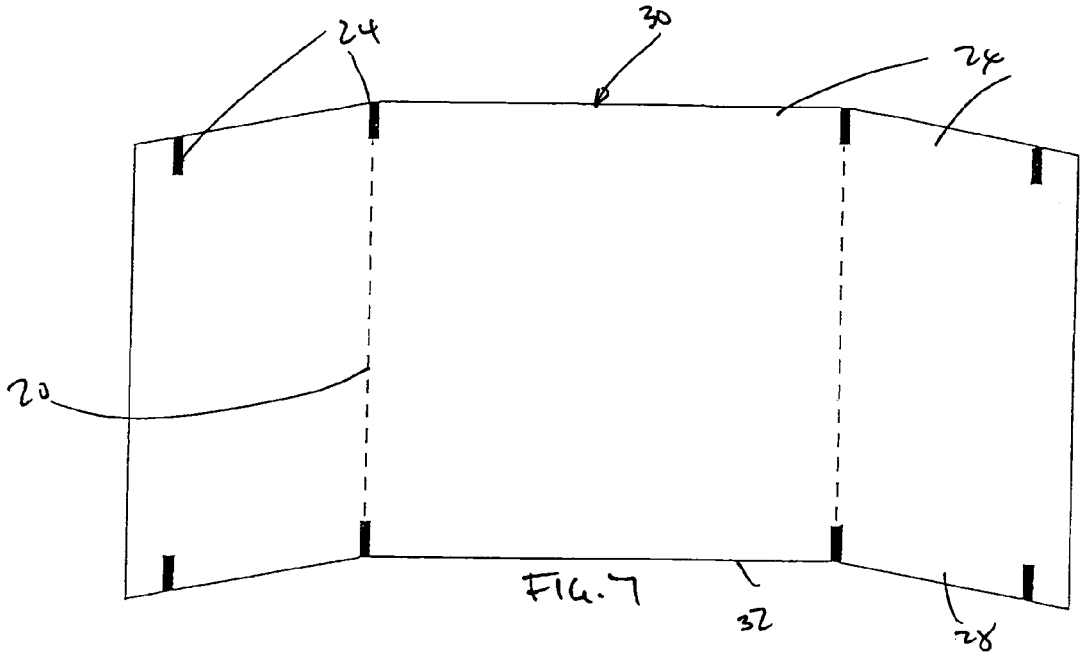
FIG. 7 is a perspective illustration of the stacked foldable display structure of the present invention including slits on the upper and lower edges.
Figure 8:
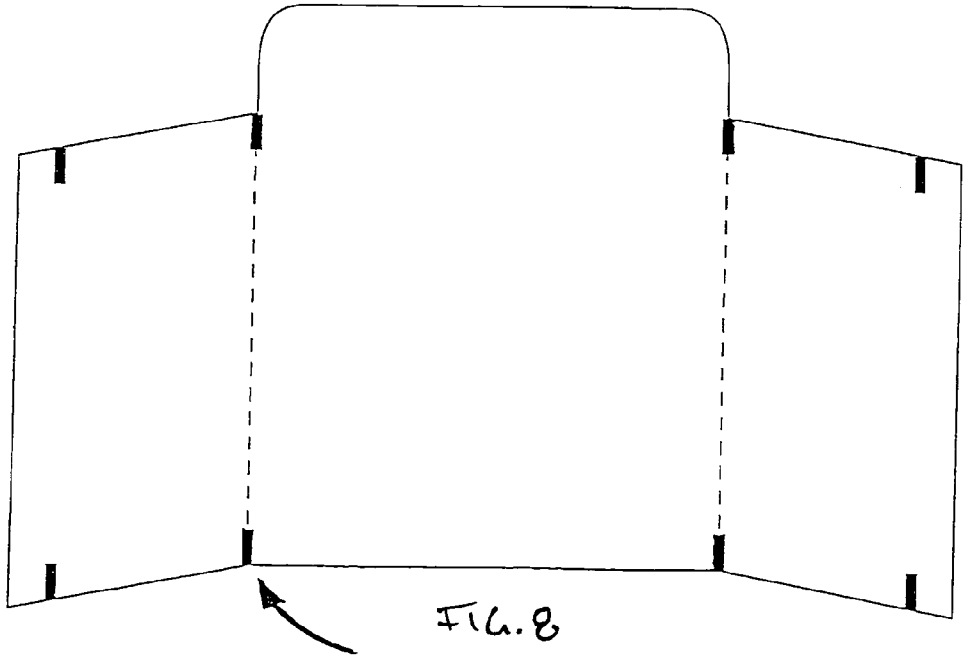
FIG. 8 is a perspective illustration of the stacked foldable display structure of the present invention including slits on the upper and lower edges and a header on the central panel.
Figure 9:
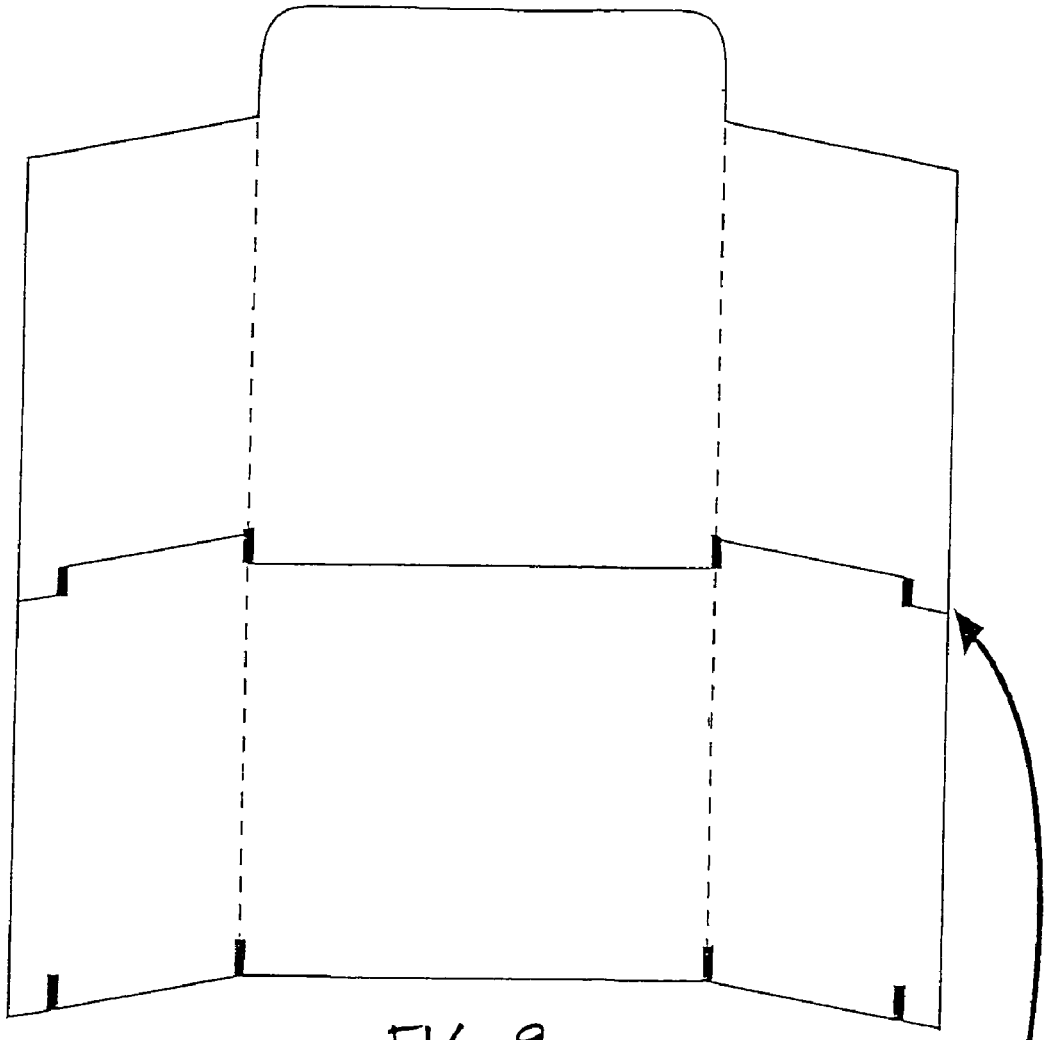
FIG. 9 is a perspective illustration of two stacked foldable display structures, each including slits lower edges, wherein the structures include a further means for attachment.
Figure 9A:
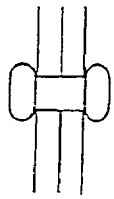
FIG. 9A is a cross-sectional view of the attachment means of FIG. 9.

Adjacent display structures are attached to each other by means of attachment means 22. In the preferred embodiment, attachment means 22 comprise a series of four slits 24 which are disposed on the top and bottom of the display structure 10 to create upper flaps 26 and lower flaps 28. The upper flaps 26 and lower flaps 28 correspond in size, shape and location along the upper edge 30 and lower edge 32 of the display structure 10 such that they may be interlocked and create a friction fit to hold the display structures 10 in position during presentation, as illustrated in FIG. 4. The means by which the upper flaps 26 and lower flaps 28 engage each other is shown graphically in FIG. 6. It should be appreciated that the slits 24 are not required along both the upper edge 30 and lower edge 32 for the structures 10 to be attached to each other—all that is required is slits 24 along the lower edge 32, as illustrated in FIGS. 1-2.

In the preferred embodiment, at least two slits 24 are disposed at the point of the hinges 20 along the lower edge 28 and at least two hinges 24 are disposed at the point of the hinges 20 along the upper edge 30. The remaining two slits 24 along the lower edge 28 are disposed one each on the left and right panels 16, 18 as are the remaining two slits 24 along the upper edge 30. It should be appreciated that additional slits 24 may also be used, provided complementary slits 24 are disposed along both the lower edge 28 and upper edge 30.

Figure 5:
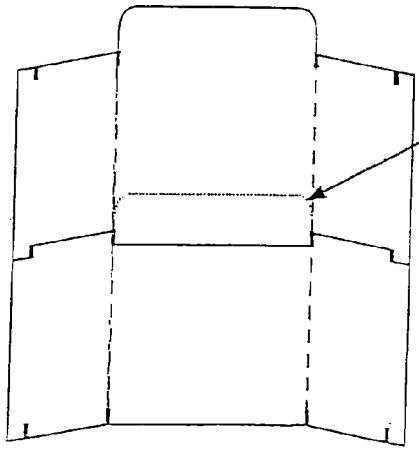
FIG. 5 is a perspective illustration of two stacked foldable display structures, each including slits on the upper and lower edges, both structures including a header.

A header 34 may also be provided on the center panel, which header 34 extends above the two side panels 16, 18, and serves as additional support for a display structure 10 stacked above it, as illustrated in FIG. 5.

Should there be the desire for a stronger interlocking mechanism than simple slits 24, a variety of well known tabs or tab-like structures 36 may be used to allow display structures 10 to interlock. For example, tabs 36 that would have a male and female part to form an interlocking position may be used, as may glue flaps that would allow insertion of a tab-like structure. An example of such structure is illustrated in FIG.

9A. Additionally, a variety of additional fasteners, such as hook and loop fasteners, snaps, screws, or others fasteners made from paper, plastic, metal may be introduced to provide additional stability to the stacked structures 10.

Another way to create more friction or stability is to adjust the length and width of the slits 24, adding more slits 24, and or adding slits 24 to both the top and bottom of the display (as shown in FIG. 4). It should be appreciated that any number of slits 24, slots or similar structures may be used in order to interconnected stacking constructions, including slits 24 at both the bottom of one display 10 and corresponding slits 24 at the top of the other display 10. It has been found, however, that the fours slits 24 are ideal inasmuch as they allow for the easy attachment of the stacking display structures 10 while providing sufficient support to retain the display structures 10 in position.

This alternating interlocking tab stacking mechanism would also work for multi-panel (four or more) display structures 10, as in the creation of pillars, multi-sided kiosks, and walls, as shown in FIGS. 11-12 and FIGS. 16-17.

Figure 14:
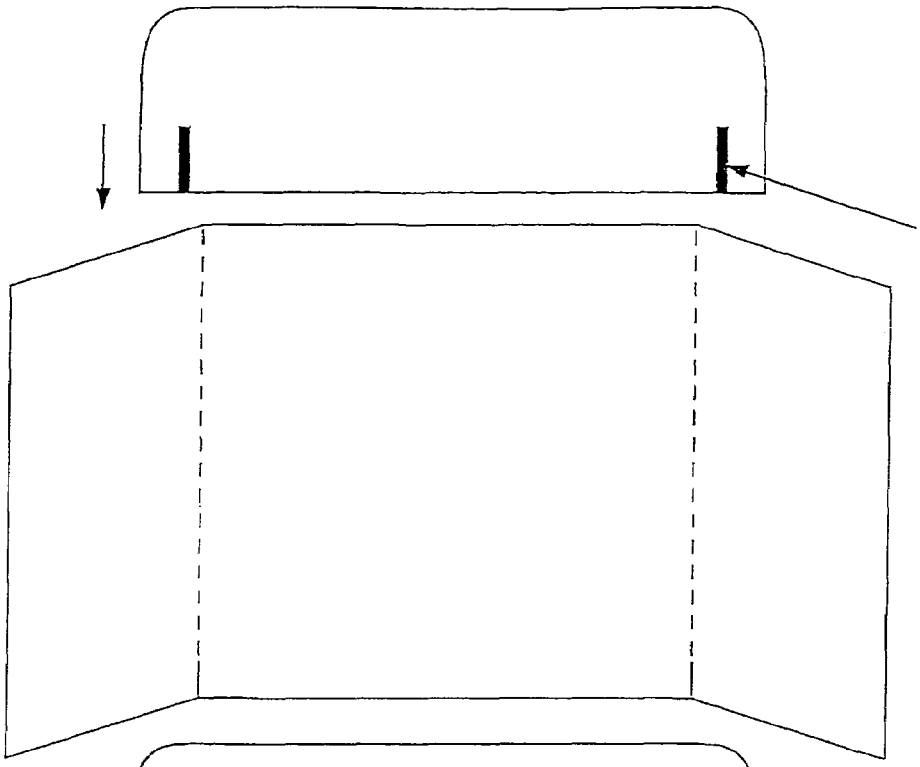
FIG. 14 is a front perspective view of an alternative embodiment of the foldable display structure in which the header is a separate element including slits disposed thereon.
Figure 15:
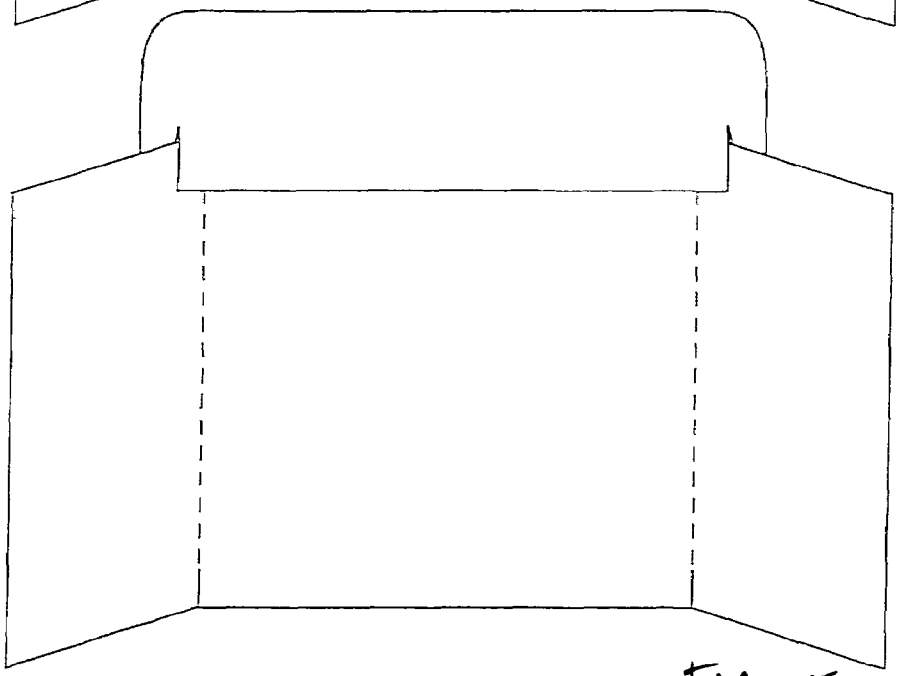
FIG. 15 is a front perspective view of the alternative embodiment of the foldable display structure of FIG. 14 showing the attachment of the header.
Figure 16:
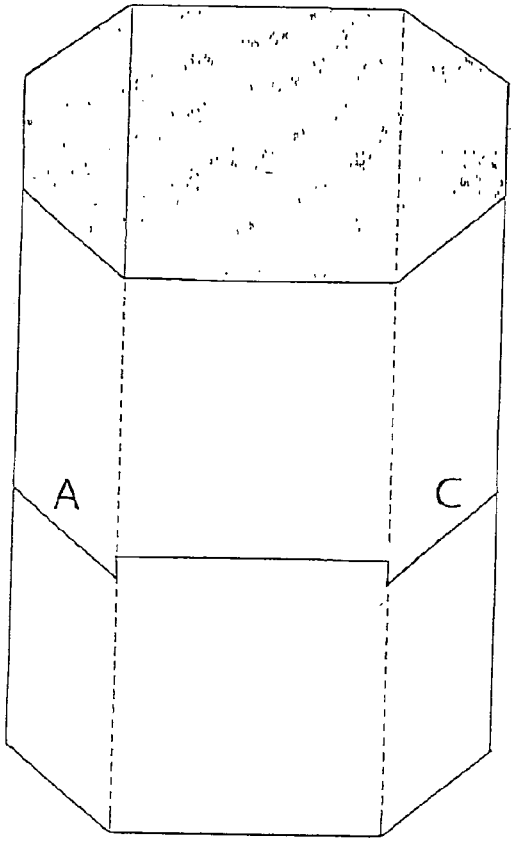
FIG. 16 is a top plan view of yet another arrangement for multiple foldable display structures of the present invention.
Figure 17:
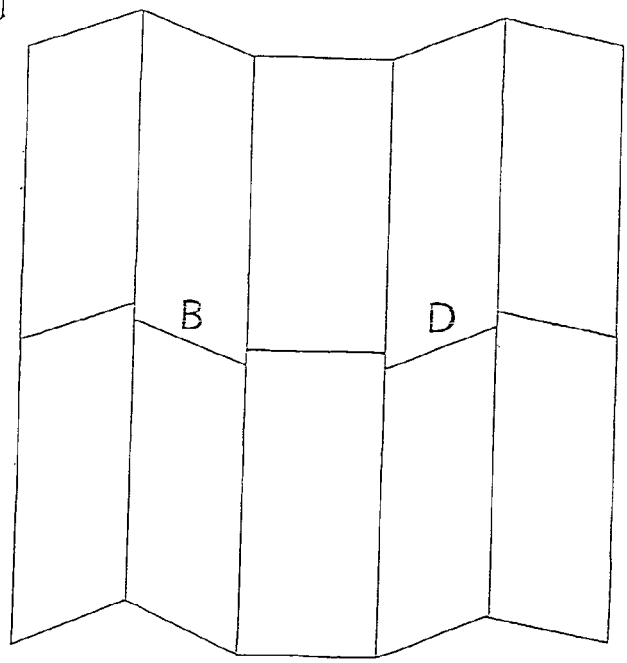
FIG. 17 is a top plan view of still another arrangement for multiple foldable display structures of the present invention.

In an alternative embodiment, an existing display may be improved with the use of a separate header 34 having two or more slits 24, as shown in FIGS. 14-15. The benefit of the use of such a header 34, aside from the aesthetic appeal and the increased area for display, is that it serves as structural support for the entire display. Once placed in position, the header 34 having slits 24 will serve to keep the two side panels 16, 18 of the display structure 10 in place.

Figure 13:
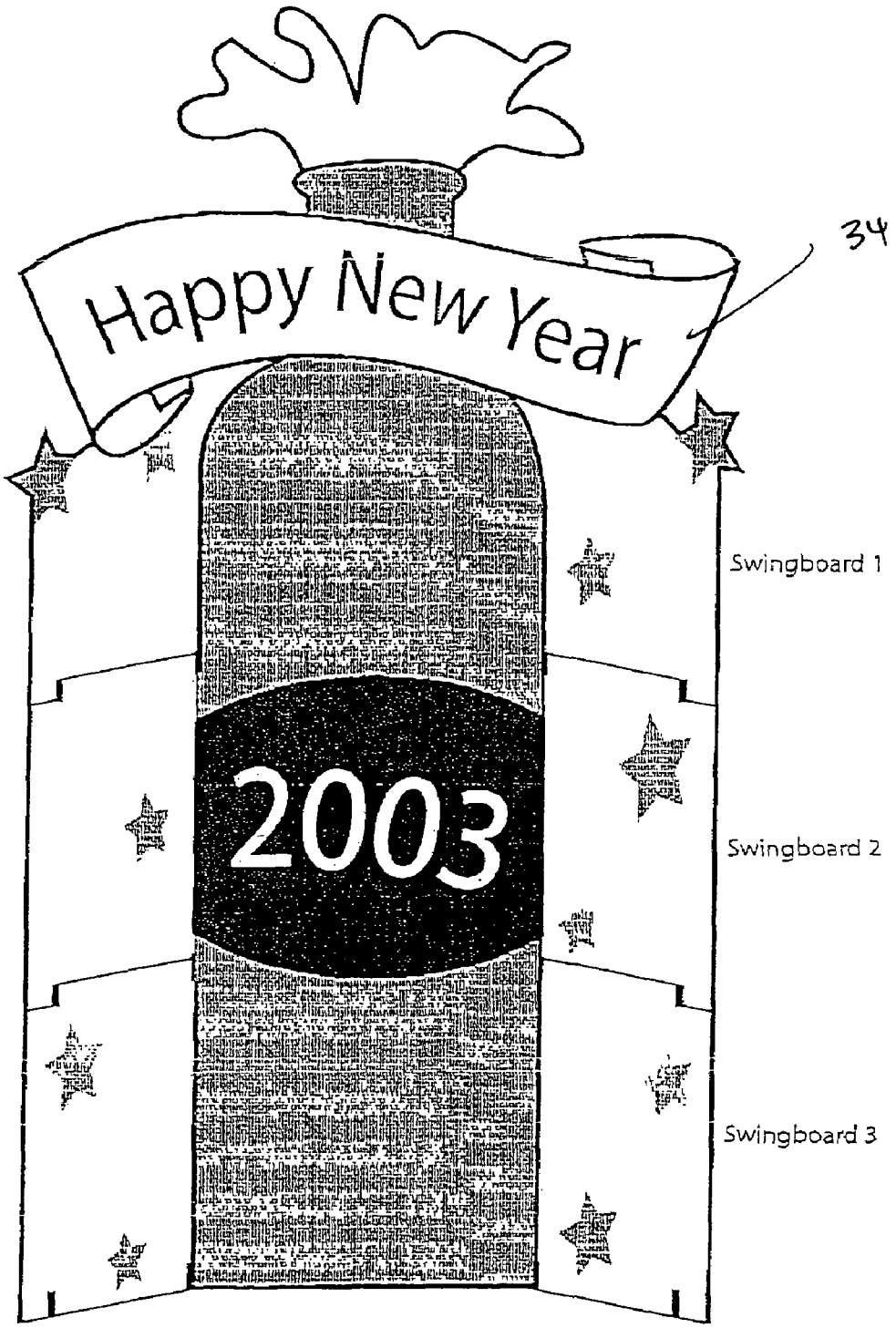
FIG. 13 is a front perspective view of an alternative embodiment of the foldable display structure of the present invention including decorative header.
Figure 18:
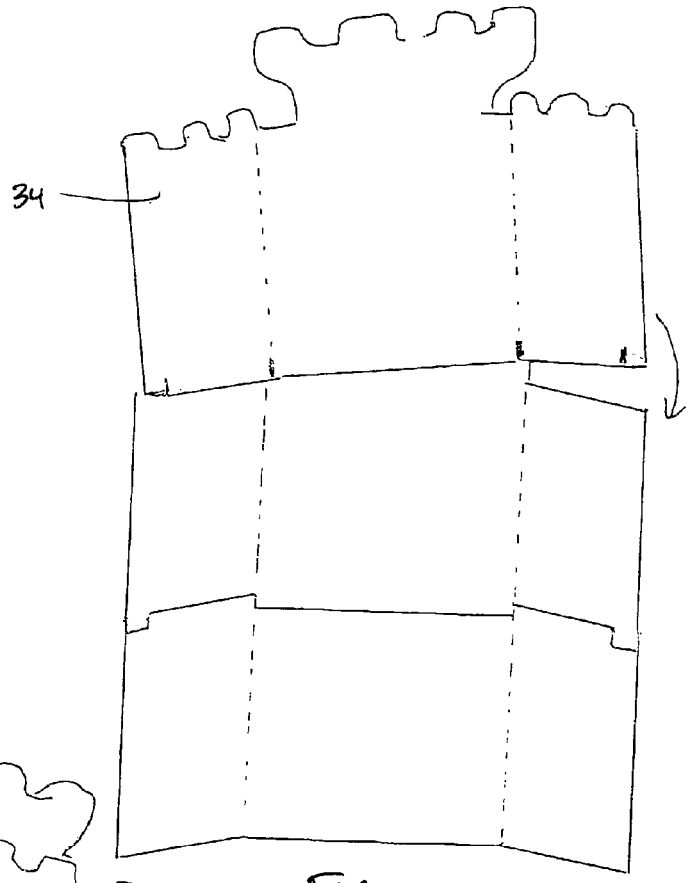
FIG. 18 is a perspective illustration of a smaller embodiment of the foldable display structure of the present invention.
Figure 19:
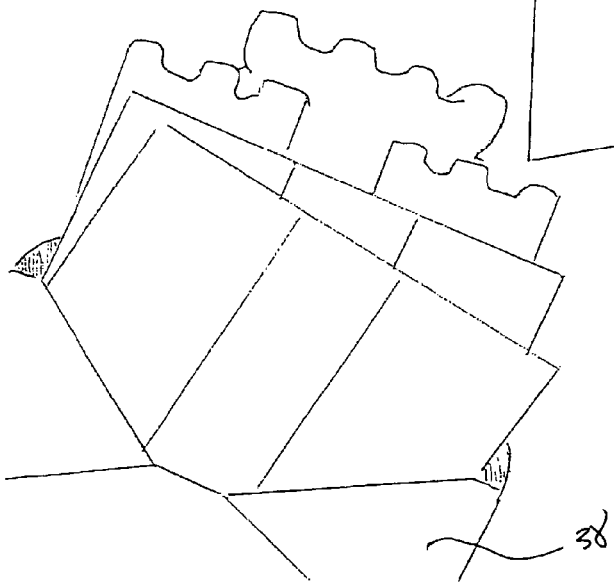
FIG. 19 is a perspective illustration of the packaging of the smaller embodiment of FIG. 18.

In another alternative embodiment, as shown in FIGS. 18-19, a smaller version of the display structure 10 may be provided, said version being constructed out of cardstock or similar material, which may be used as a form of greeting card or ornamental display for toys and games. The elements of such a smaller version of the structure 10 are the same as the larger version, including the slits 24 and flaps 28, but the entire structure 10 may be disassembled, folded and inserted into an envelope 38 for mailing or distribution. Decorative headers 34 may also be utilized in this embodiment, as well as the larger embodiment, as illustrated in FIG. 13.

Figure 20:
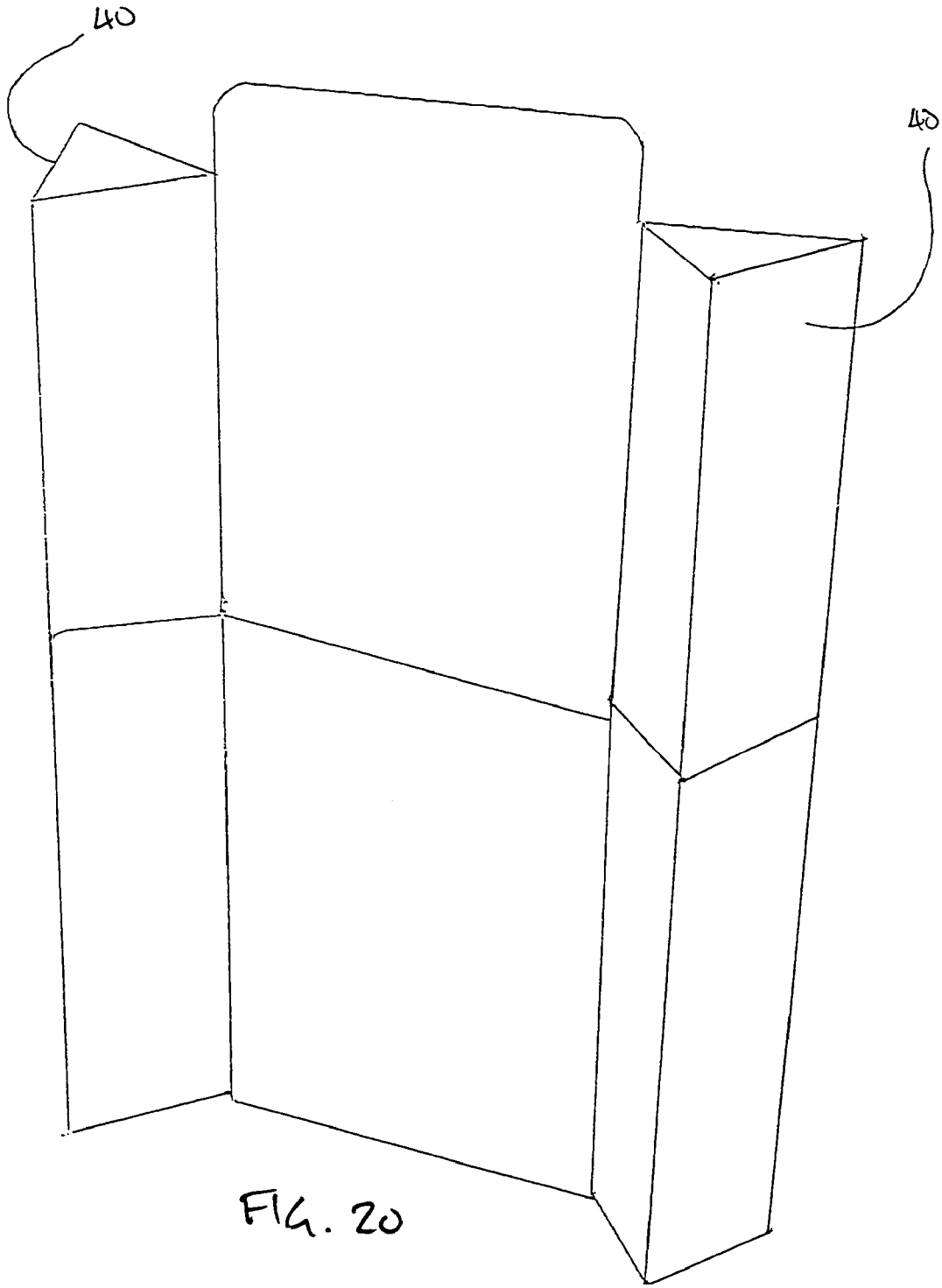
FIG. 20 is a perspective illustration of yet another embodiment of the foldable display structure of the present invention in which two structures are disposed back to back and attached by means of side panels.

In yet another embodiment, two stacked or unstacked display structures 10 may be placed back to back, as shown in FIG. 20 and attached to each other by means of side panels 40, which serves to give the attached structures 10 a three-dimensional shape. The side panels 40 may be attached by any conventional means, such as by tabs, adhesives, hook and look fasteners, snaps, etc.

Wherefore, I claim:

1. A stackable display structure having an opened and closed position comprising a first and a second construction element, each having at least three panels, said panels being hingeably interconnected such that the panels may be folded against each other when said structure is in the closed position, wherein said panels include at least four slits at the bottom thereof, said slits being substantially shorter in length than the height of said panels and being situated so as to enable the attachment of said first construction element to the top of said second construction element in a stacked relationship to thereby create a display structure having a height roughly equal to the combined height of said first and said second construction elements.

2. The stackable display structure of claim 1, said three panels comprising a center panel, a left panel and a right panel, wherein the combined width of said left panel and said right panel is less than the width of said center panel.

3. The stackable display structure of claim 1, said three panels comprising a center panel, a left panel and a right panel, wherein the combined width of said left panel and said right panel is greater than the width of said center panel.

4. The stackable display structure of claim 1, said three panels comprising a center panel, a left panel and a right panel, wherein the width of said left panel and the width of said right panel is approximately equal to the width of said center panel.

5. The stackable display structure of claim 1, wherein said slits cooperate to create a plurality of flaps, which flaps serve to frictionally engage said second display structure in a stacked relationship.

6. The stackable display structure of claim 1, said three panels comprising a center panel, a left panel and a right panel, wherein said center panel includes a header that extends above the top of both said left panel and said right panel.

7. The stackable display structure of claim 6, wherein said header includes decorative elements.

8. The stackable display structure of claim 1, further including a separate header element including at least two slits disposed therein for attaching said header to said construction.

9. The stackable display structure of claim 1, further including at least four additional slits being disposed at the top thereof, said top slits and said bottom slits being complementary in shape, size and disposition so as to facilitate the attachment of two or more display structures.

10. The stackable display structure of claim 1, said three panels comprising a center panel, a left panel and a right panel each connected to each other by means of a hinged connection, wherein two of said slits are disposed along said hinged connection, one of said slits is disposed along the bottom of said left panel and the remaining slit is disposed along the bottom of said right panel.

11. The stackable display structure of claim 1, further including one or more additional construction elements each including said slits to enable said additional construction elements to be attached in a stacked relationship to said first and second construction elements.

* * * * *